United States Patent [19]

Cooper et al.

[11] Patent Number: 4,653,698

[45] Date of Patent: Mar. 31, 1987

[54] SAFETY SYSTEM FOR COAL PULVERIZERS

[75] Inventors: Marshall H. Cooper, Solon; Robert E. Pocock, Highland Hts., both of Ohio

[73] Assignee: The Babcock & Wilcox Company, New Orleans, La.

[21] Appl. No.: 899,765

[22] Filed: Aug. 22, 1986

Related U.S. Application Data

[63] Continuation of Ser. No. 751,479, Jul. 3, 1985, abandoned, which is a continuation of Ser. No. 519,352, Aug. 1, 1983, abandoned.

[51] Int. Cl.[4] ..... B02C 25/00

[52] U.S. Cl. ..... 241/31; 241/33; 241/DIG. 14

[58] Field of Search ..... 241/31, 38, 47, 65, 241/DIG. 14, 33, 30; 60/39.091

[56] References Cited

U.S. PATENT DOCUMENTS

| | | | |
|---|---|---|---|
| 3,477,650 | 11/1969 | Williams | 241/47 |
| 3,909,954 | 10/1975 | Zoukourian | 241/31 X |
| 4,226,371 | 10/1980 | Williams | 241/31 |
| 4,244,529 | 1/1981 | DeGabriele et al. | 241/31 X |

FOREIGN PATENT DOCUMENTS

| | | | |
|---|---|---|---|
| 1485448 | 9/1977 | United Kingdom | 241/DIG. 14 |

*Primary Examiner*—Howard N. Goldberg
*Assistant Examiner*—Joseph M. Gorski
*Attorney, Agent, or Firm*—Vytas R. Matas; Robert J. Edwards

[57] ABSTRACT

A safety control system is disclosed for a coal pulverizer utilizing the measurements of net oxygen and carbon monoxide measurements of the pulverizer atmosphere. First levels of net oxygen and rate of carbon monoxide change are utilized in a control logic system to actuate alarms and automatic inerting of the pulverizer is accomplished utilizing a second level of net oxygen measurement and absolute carbon monoxide level in the pulverizer.

6 Claims, 2 Drawing Figures

SAFETY SYSTEM FOR COAL PULVERIZERS

This is a continuation of copending application Ser. No. 751,479 filed on 7-3-85 now abandoned which is a continuation of application Ser. No. 519,352 now abandoned filed on 8-1-83.

TECHNICAL FIELD

The present invention generally relates to control systems for coal pulverizers and particularly to safety control systems for detecting and controlling hazardous conditions in a coal pulverizer.

BACKGROUND ART

Known pulverized-coal systems pulverize coal, deliver it to the fuel-burning equipment, and accomplish complete combustion in the furnace with a minimum of excess air. The system operates as a continuous process and, within specified design limitations, the coal supply or feed can be varied as rapidly and as widely as required by the combustion process.

A small portion of the air required for combustion (15 to 20% in current installations) is used to transport the coal to the burner. This is known as primary air. In the direct-firing system, primary air is also used to dry the coal in the pulverizer. The remainder of the combustion air (80 to 85%) is introduced at the burner and is known as secondary air.

All coals, when exposed to air, undergo oxidation even at room temperature. This tendency varies with coal type: anthracite and semi-anthracite, for example, are little affected whereas many bituminous coals are particularly liable to absorb and combine with oxygen. The process of oxidation continues with increasing rapidity as the temperature rises. Heat is generated which, if allowed to accumulate, could result in thermal decomposition and ignition of the coal. Volatile components of the coal, such as methane and related compounds, are released during the decomposition. Accumulation of these gaseous materials may be ignited at fairly low temperatures and rapidly propagate fire or explosion.

Spontaneous combustion of coal is dependent on a sufficient supply of oxygen to maintain the reaction and on the surface area exposed. Coals with a high surface area, due to small particle size, as in pulverized coal fuel, are particularly liable to self heating. This problem is of special significance to the safe operation and performance of industrial coal pulverizers. Spontaneous combustion may result in deterioration in the quality of the coal, in damage to the power plant, and in certain cases, for example, where critical concentrations of coal dust are involved, may provide the ignition source for an explosion.

Present systems for fire detection in industrial coal pulverizers use either thermocouples to measure the rise in outlet temperature of the pulverizing mill or infrared gas analyzers to detect the buildup of CO produced in the mill.

Thermocouples or RTD's are normally part of the control system for mill operation. However, they are a relatively insensitive means for detecting pulverizer fires. At best, they warn of impending trouble only a few minutes before it actually occurs, and in some cases, do not even detect a significant temperature rise before a fire or explosion is evident. The ineffectiveness of thermocouples and RTD's in this application is due, in part, to the shielding used to protect them from the corrosive coal particles. Shields reduce heat conduction, slowing response time.

Actual CO measurements are also used for fire detection in coal pulverizers since that CO buildup is related directly to the oxidation rate of coal. Infrared gas analyzers are used to compare the CO content of the incoming and outgoing mill air and in effect, the amount of CO produced in the mill. Currently available infrared gas analyzers require extensive filtering and dehydration of the gas sample extracted from the mill, to prevent interference by water vapor and particulate matter. Due to the high cost and maintenance requirements of infrared absorption analyzers, it is the usual practice to use one analyzer for several measurement points. Continuous measurement of each mill is not provided, thus, slowing response time. Nevertheless, this provides an improvement over the thermocuple and RTD method described. Additional problems occur, at some power plants, where appreciable concentrations of CO can be found in the air supply to the mill. Since in such plants CO in the boiler flue gases is transferred to the combustion air via the regenerative air heater and it thus becomes necessary to provide an analysis of the air entering the mill.

Thus, it is seen that an accurate and reliable safety system was required for coal pulverizers which would provide an early warning of impending safety problems in coal pulverizers.

SUMMARY OF THE INVENTION

The invention described herein overcomes the stated problems of prior art safety systems and provides an improvement over the existing art. It is not dependent on the measurement of mill outlet temperature, the removal of moisture and all particulate matter from the sample extracted from the mill or multi-point sampling. The invention incorporates the use of a standard single point oxygen and CO analyzer directly mounted to the coal pulverizing mill providing a continuous percent by volume measurement of oxygen content and a continuous measurement of CO gas concentration of the mill atmosphere. The $O_2$ portion of the analyzer uses a sensor operating at a temperature where any combustible volatile material will combine with $O_2$ in the sample. The sensor will then respond to the free or uncombined $O_2$ remaining. The resulting measurement, denoted net or residual, $O_2$, can be correlated with the amount of combustible volatiles within the mill. An additional significant indicator of a potentially hazardous condition is, thus, provided, augmenting the CO measurement. The combined measurement of CO and net $O_2$ concentration in the mill atmosphere is used to indicate and alarm both the onset and progress of spontaneous combustion within the mill.

Thus, one aspect of the present invention is to provide an automated system capable of being integrated into a plant's pulverizer management and combustion control system designed to monitor the performance of and detect impending fires and explosions in industrial coal pulverizers and alarm such conditions.

Another aspect of the present invention is to provide an automated alarm system based on a net oxygen measurement in the coal pulverizer.

Yet another aspect of the present invention is to provide an automated alarm system based on a predetermined carbon monoxide rise per time.

Still yet another aspect of the present invention is to provide an automated inerting control of the coal pulverizer upon detection of either a predetermined net oxygen level or an absolute carbon monoxide level.

These and other aspects of the present invention will be more fully understood upon a perusal of the following description of the preferred embodiment considered in combination with the drawings.

DESCRIPTION OF THE PREFERRED EMBODIMENT

Figure 1:
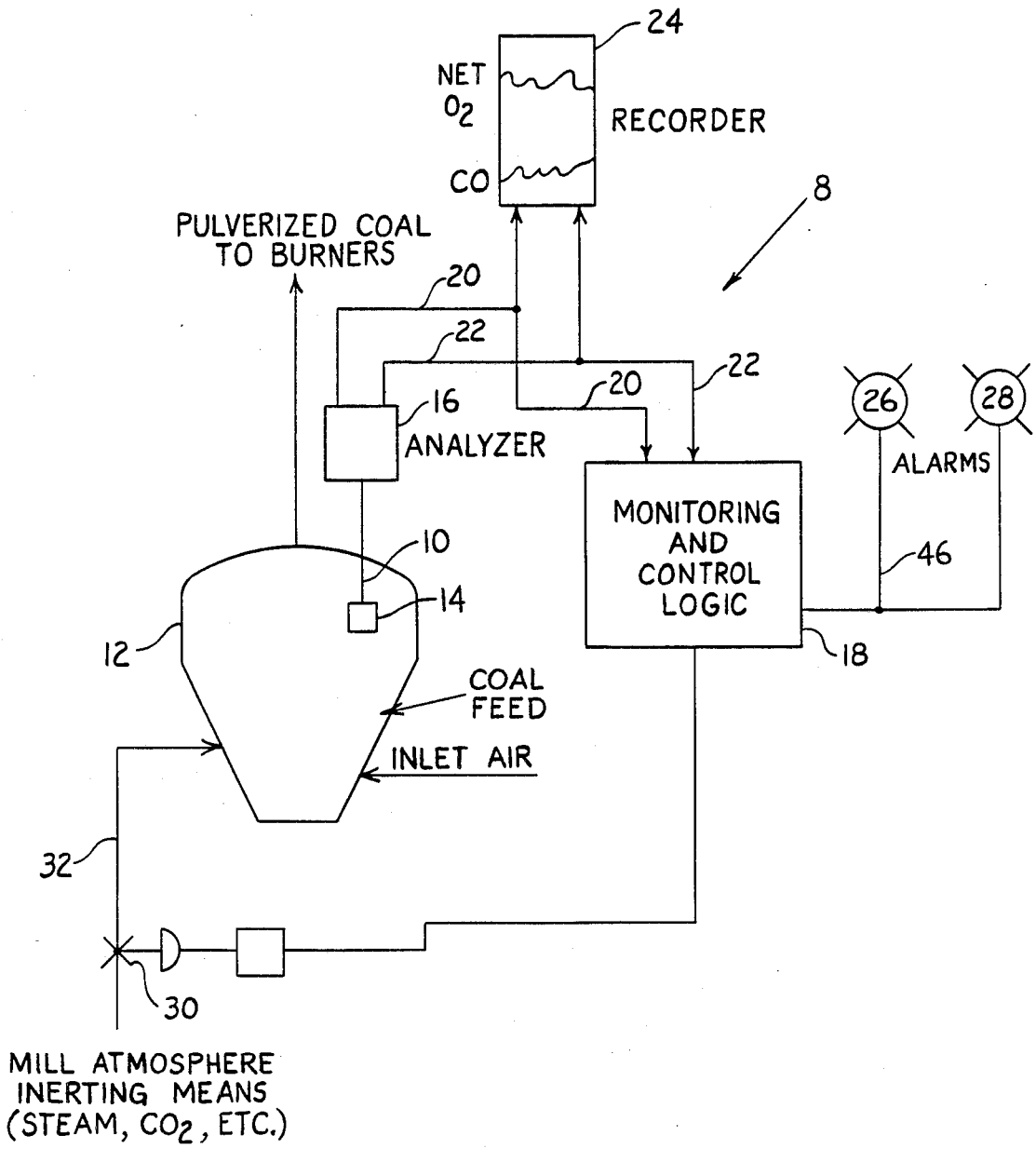
FIG. 1 is a schematic drawing of the safety control system of the present invention.

Referring now to the drawings, the invention described herein is a reliable, relatively low-cost automated safety system 8 capable of being integrated into a plant's computer control system designed to monitor the performance of and detect impending fires and explosions in electric-utility and industrial coal pulverizers by monitoring the level of carbon monoxide (CO) and net oxygen ($O_2$) concentration in a pulverized coal mill atmosphere. The combined measurement of CO and $O_2$ concentration in the mill atmosphere is used to indicate the oxidation rate of the coal to preclude spontaneous combustion. Additionally, the measurement of net $O_2$ concentration, when combined with other measurements may provide the basis for overall mill performance calculations and the quality of the pulverized coal.

As shown in FIG. 1, the CO/$O_2$ sample probe 10 is typically placed in a coal pulverizer 12 classifier outlet zone. A sample of gas is drawn through the probe 10 which has a porous high temperature filter 14. The filter 14 is required to maintain trouble-free operation by minimizing the amount of particulate matter drawn into the analyzer. A suitable filter 14 for this application is of a type described in U.S. Pat. No. 4,286,472.

The air sample drawn from the coal pulverizer 12 is then analyzed for percent by volume of oxygen ($O_2$) content and CO gas concentration in ppm (parts per million) via a known oxygen and CO gas analyzer 16 designed to operate in a harsh power plant environment and having autocalibration capabilities. A suitable analyzer for this application is one manufactured by the Bailey Controls Company of Babcock and Wilcox and is known as the Type OL Oxygen and CO Analyzer. This analyzer 16 has a CO range of 0–1000 ppm and an $O_2$ range of 0.1–25%. Electrical signals corresponding to carbon monoxide and oxygen concentrations are respectively transmitted to a monitoring system control 18 located in the central control room along lines 20 and 22. CO and $O_2$ concentrations are displayed and/or recorded on a strip-chart recorder 24. During normal pulverizer 12 operation, net $O_2$ levels represent typically 16% $O_2$ and normal CO levels range between 40 and 80 ppm. If the net $O_2$ concentration falls below a certain predetermined level, typically 15% and/or the amount of CO produced exceeds a predetermined rise level considered cause for concern, typically a 50 ppm/minute sudden rise, the system 8 activates audible and visible alarms 26, 28 to alert the operator who in turn may manually take corrective action to inert the pulverizer 12 or permit the automatic monitoring system 8 to continue until it initiates an automatic inert to bring the pulverizer 12 operating parameters under control.

Figure 2:
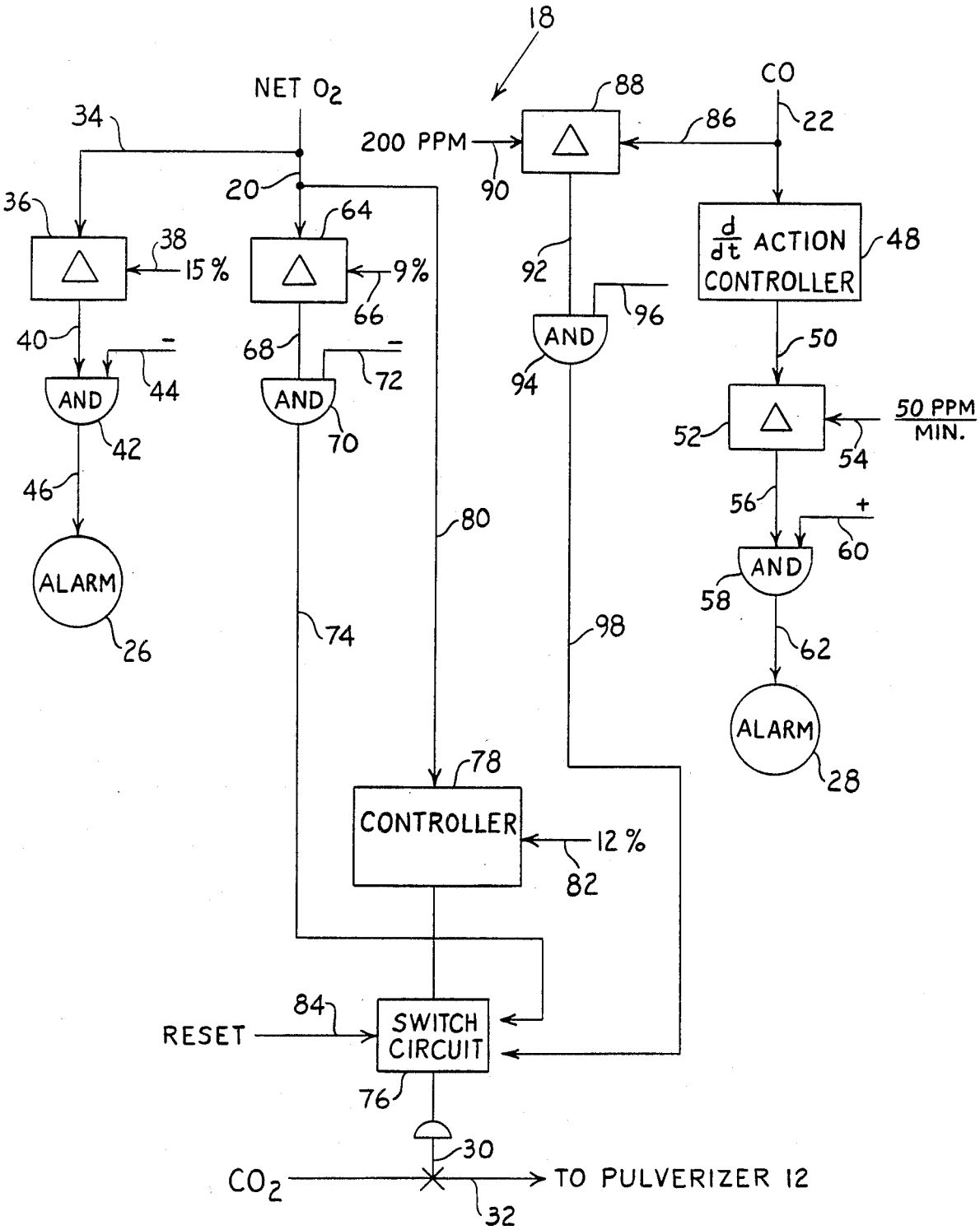
FIG. 2 is a schematic of the monitoring and control logic of the FIG. 1 safety control system.

Referring now to FIG. 2, it will be seen that the monitoring and control logic assembly 18 utilizes both a net oxygen measurement provided by the analyzer 16 along line 20 as well as a carbon monoxide measurement provided along line 22 from analyzer 16. To, on the one hand. actuate alarms 26 and 28 at predetermined levels of net oxygen and predetermined rise times of carbon mcnoxide concentration. Also, when the net oxygen levels and the absolute carbon monoxide levels exceed certain critical limits, automatic inerting of the pulverizer 12 is accomplished by controllably opening a valve 30 which allows some inerting media such as carbon dioxide or steam to flow along a line 32 into the pulverizer 12.

Turning first to the alarm functions, it will be seen that the net oxygen measurement from line 20 is transmitted along a line 34 to a difference station 36 having a setpoint set at a predetermined net oxygen control point transmitted along line 38. The difference station 36 compares the actual net oxygen measurement provided by the analyzer 16 representing the net oxygen level in the pulverizer 12 and compares it with the setpoint oxygen level which, in the present situation, is set at 15%. The present setpoint of 15% is based on the assumption that the typical atmosphere in the pulverizer representative of normal conditions is approximately 16% and the initial alarm condition is desired to be a warning indicative of potential problem areas.

The difference station 36 thus compares the two signals and provides an error signal along line 40 which is one input of an AND gate 42. The other input of the AND gate 42 is provided by a constant negative signal from a predetermined source along line 44. Thus, as long as the net oxygen level provided to the difference station 36 along line 34 is greater than the 15% setpoint, a positive level error signal will be transmitted along line 40 to the AND gate 42 which then will fail to provide any control signal along line 46, failing to actuate the alarm 26. As soon as the net oxygen level falls below the 15% setpoint, the output along line 40 becomes negative and in combination with the constant negative signal along line 44, will result in a conduction of the AND gate 42, causing a control signal to be transmitted along line 46 to the alarm 26 to thus actuate it and provide an indication of potential problems in the pulverizer 12 atmosphere.

Alternatively, the measured carbon monoxide signal transmitted along line 22 may also provide an actuation of the alternate alarm 28. The measured carbon monoxide signal is transmitted to a derivative action controller 48 which will be sensitive to any variations in the carbon monoxide level and will effectively provide an output signal along line 50 indicative of the slope or rate of change of the carbon monoxide level in the pulverizing mill 12. The output of the derivative action controller 48 is transmitted to a difference station 52 having a predetermined setpoint along line 54 indicative of a rate of carbon monoxide change which would indicate coal ignition in the pulverizer 12. Such a rate of change is typically taken to be a 50 ppm/minute rate of carbon monoxide change. The output of the difference station 52 is transmitted along the line 56 to an AND gate 58 having a second input of a constant negative value provided along line 60. In operation, the rate of carbon monoxide change normally stays below the 50 ppm/minute setpoint resulting in a negative output signal from the difference station 52. Whenever the actual rate of carbon monoxide change exceeds the setpoint of line 54, the signal transmitted along line 56 turns positive, causing the AND gate 58 to start conducting a control signal along line 62 to the alarm 28 actuating the alarm 28 to indicate a potentially hazardous atmosphere in the pulverizer 12.

These individual alarms, when actuated, warn the operator of potentially hazardous conditions in the pulverizer. This should indicate to the operator that close monitoring of the pulverizer is required and typically one alarm will be actuated, possibly followed by the second alarm. Since the inerting of a pulverizer may shock the pulverizer, such inerting is left to the discretion of the operator and his supervisor. However, there are certain conditions beyond which inerting of the pulverizer 12 is mandatory and should be automatically initiated. To provide for such automatic inerting, the control system 8, again, utilizes both the net oxygen measurements and the carbon monoxide measurements provided by lines 20 and 22, respectively.

Automatic inerting of the pulverizer 12 is actuated by a difference station 64 which has a setpoint provided to it along line 66 having a net oxygen level significantly lower than the setpoint level provided to difference station 36. Typically, the difference station 64 has a net oxygen setpoint of 9%. Thus, during normal pulverizer 12 operation, the net oxygen level measured and transmitted to the difference station 64 will exceed the 9% setpoint and the error signal produced by the difference station 64 will be a positive level signal transmitted along line 68 to an AND gate 70. The other input of the AND gate 70 is provided by a constant negative level signal transmitted to the AND gate 70 along line 72. Thus, during normal operation, the inputs to the AND gate 70 will be positive and negative, providing no control signal from the output of the AND gate along line 74. Whenever the oxygen level of the pulverizer 12 falls below the 9% setpoint level, the output of the difference station 64 turns negative, providing two negative inputs to the AND gate 70 and resulting in a control signal along line 74 being transmitted to a switching circuit 76. The switching circuit 76 is a normally open circuit, preventing the signal transmitted from a controller 78 from reaching the control valve 30. When the control signal from line 74 is present, the switching circuit 76 changes to a closed-circuit condition, turning over control of the valve 30 to the controller 78.

The controller 78 has an input signal indicative of the actual net oxygen level in the pulverizer 12 which is provided by a parallel line 80, paralleling the net oxygen signal in line 20. The setpoint of the controller is provided along line 82 from some predetermined setpoint station and is typically set at a 12% level. Thus, when the switching circuit 76 is actuated by a control signal from the AND gate 70, the controller 78 will open valve 30, causing an inerting atmosphere, such as carbon dioxide, to be delivered to the pulverizer 12 until a somewhat normal ambient is reached close to the setpoint level of 12%. The reason for keeping the setpoint of the controller 78 at a somewhat lower than typically normal atmosphere is to minimize the shock to the pulverizer 12 due to the inerting process. The switching circuit is then switched back to its normally open condition by a reset signal provided along line 84 from either a manual source or an automatic source which can be tied to some parameter indicative of the reestablishment of normal ambient conditions in the pulverizer 12.

The actuation of the automatic inerting means is also alternatively done upon the sensing of a predetermined absolute level of carbon monoxide in the pulverizer 12. The carbon monoxide signal normally provided along line 22 is tapped by a line 86 to provide one input of a difference station 88. The setpoint of the difference station 88 is provided along line 90 from a predetermined setpoint station typically set at an absolute carbon monoxide level of 200 ppm. Thus, as long as the carbon monoxide level stays below a 200 ppm value indicative of normal operation, a positive error signal will be transmitted by the difference station 88 along line 92 to an AND gate 94. The other input to AND gate 94 is provided by a line 96 connected to a constant negative level source. Thus, during normal pulverizer 12 operation, opposite polarity signals are provided to the AND gate 94, preventing the establishment of any control signal along line 98 from the AND gate 94. Whenever the absolute carbon monoxide level exceeds the predetermined setpoint of 200 ppm, the error signal transmitted to the AND gate 94 turns negative, causing the conduction of the AND gate 94 and the establishment of a control signal along line 98 to the switching circuit 76. As was described earlier, with reference to the net oxygen level control, this causes the switching circuit 76 to become conductive, turning control of the valve 30 over to the controller 78. Again, automatic inerting of the pulverizer 12 occurs until a reset signal is established along line 84, causing the switching circuit 76 to again become non-conductive and causing the valve 30 to switch its normally closed position.

It will be understood that certain modifications and improvements will occur to those skilled in the art upon a reading of this specification. All such modifications and improvements have been deleted herein for the sake of conciseness and readability but are properly intended to fall within the scope of the following claims

We claim:

1. A safety system for a coal pulverizer, comprising:

means for measuring actual carbon monoxide level in the coal pulverizer;

a derivative action controller means connected to said measuring means, for providing an output signal indicative of rate of actual carbon monoxide level change in the coal pulverizer;

means for comparing the signal from said controller means with a predetermined setpoint signal indicative of a rate of carbon monoxide level change in the coal pulverizer indicating coal combustion, and for establishing a control signal therefrom;

inerting means, responsive to said control signal, for inerting coal combustion in the coal pulverizer;

means for measuring an actual net oxygen level in the coal pulverizer and for establishing a signal indicative thereof; and second means for comparing the signal from said net oxygen measuring means with a predetermined setpoint signal indicative of a potentially harazardous net oxygen level, and for establishing a control signal for actuaitng an alarm indictive of the potentially hazardous condition.

2. A safety system as set forth in claim 1 further including:

means for comparing the signal from said net oxygen measuring means with a second predetemined setpoint signal that is lower in value than said first predetermined setpoint signal, and for establishing a second control signal therefrom for actuating said inerting means.

3. A safety system as set forth in claim 2 wherein said inerting means includes:

a source of inerting atmosphere for inerting the coal pulverizer;

valve means for controlling said source of inerting atmosphere; and controller means, responsive to the signal from said means for measuring the net oxygen level in the coal pulverizer, for controlling said valve means.

4. A safety system as set forth in claim 3 including switching means, mounted between said controller means and said valve means and being responsive to either the control signal from the comparing means comparing the absolute carbon monoxide level in the coal pulverizer with the predetermined setpoint signal, or the control signal from the comparing means comparing the net oxygen level in a coal pulverizer with a second predetermined setpoint signal for allowing control of said valve means by said controller means.

5. A safety system for coal pulverizer, comprising:

means for measuring an actual net oxygen level in said coal pulverizer and for establishing a first indicating signal indicative thereof;

means for continuously measuring a rate of change of carbon monoxide level in the coal pulverizer and for establishing a second indicating signal indicative thereof;

first comparing means for comparing said first indicating signal with a first predetermined setpoint signal, and for establishing a first control signal wherever said first predetermined setpoint signal is exceeded in value by said first indicating signal;

second comparing means for comparing said second indicating signal with a second predetermined setpoint signal, and for establishing a second control signal whenever said second predetermined setpoint signal is exceeded in value by said second indicating signal; and alarm means, responsive to either said first or second indicating signals, for indicating either a potentially harzardous condition in the coal pulverizer or an actual hazardous condition in the coal pulverizer.

6. A safety system as set forth in claim 3 further icnluding:

a second comparing means for comparing the first indicating signal indicative of the actually meausred net oxygen level in the coal pulverizer with a third setpoint signal indicative of a hazardous condition in the coal pulverizer, and for establishing an inerting control signal whenver the first indicating signal exceeds the third setpoint signal in value; and automatic inerting means, responsive to said inerting control signal, for providing an inerting atmosphere in the coal pulverizer.

* * * * *